US007762439B2

(12) United States Patent
Niggemyer et al.

(10) Patent No.: US 7,762,439 B2
(45) Date of Patent: Jul. 27, 2010

(54) VARIABLE TIP NOZZLE AND CAP ASSEMBLY FOR DISPENSING POUCH

(75) Inventors: F. William Niggemyer, Fremont, OH (US); Robert E. Simonton, Fremont, OH (US)

(73) Assignee: Decko Products, Inc., Sandusky, OH (US)

( * ) Notice: Subject to any disclaimer, the term of this patent is extended or adjusted under 35 U.S.C. 154(b) by 0 days.

(21) Appl. No.: 11/960,263

(22) Filed: Dec. 19, 2007

(65) Prior Publication Data

US 2008/0105715 A1 May 8, 2008

Related U.S. Application Data

(62) Division of application No. 10/886,896, filed on Jul. 8, 2004, now Pat. No. 7,337,923.

(51) Int. Cl.
*B65D 35/38* (2006.01)

(52) U.S. Cl. ..... 222/568; 222/92; 222/107; 222/153.05; 222/181.2; 222/562

(58) Field of Classification Search ..... 222/92, 222/95, 105, 567–568, 107, 214, 215, 181.2, 222/153.05, 541.5, 541.1, 541.6; 215/48; 220/266, 276; 383/906
See application file for complete search history.

(56) References Cited

U.S. PATENT DOCUMENTS

| | | | | | |
|---|---|---|---|---|---|
| 299,228 | A * | 5/1884 | Kirsten | 425/191 |
| 560,719 | A * | 5/1896 | Hueg | 425/191 |
| 2,620,756 | A * | 12/1952 | Krens | 425/191 |
| 2,947,015 | A * | 8/1960 | Burt | 401/183 |
| 3,023,925 | A * | 3/1962 | Sher | 220/786 |
| 3,801,247 | A | 4/1974 | Parrish et al. | |
| 3,827,593 | A | 8/1974 | Kramb et al. | |
| 3,847,523 | A * | 11/1974 | Parrish et al. | 425/191 |
| 4,362,250 | A * | 12/1982 | Cottingham | 215/247 |
| 4,760,941 | A * | 8/1988 | Salmon et al. | 222/153.07 |
| 4,961,517 | A * | 10/1990 | Tkac | 222/94 |
| 5,114,044 | A * | 5/1992 | Spanek, Jr. | 222/94 |
| 5,248,071 | A * | 9/1993 | Ray | 222/568 |
| 5,758,787 | A * | 6/1998 | Sheu | 215/11.1 |
| 6,270,277 | B1 * | 8/2001 | Ogino et al. | 401/269 |
| 6,523,720 | B1 * | 2/2003 | Robbins, III | 222/1 |
| 6,981,614 | B2 * | 1/2006 | Niggemyer | 222/107 |
| 7,337,923 | B2 * | 3/2008 | Niggemyer et al. | 222/107 |
| 2003/0205584 | A1 * | 11/2003 | Niggemyer | 222/107 |
| 2005/0087556 | A1 * | 4/2005 | Signorini | 222/214 |
| 2006/0006194 | A1 | 1/2006 | Niggemyer et al. | |

* cited by examiner

*Primary Examiner*—Frederick C. Nicolas
(74) *Attorney, Agent, or Firm*—Fraser Clemens Martin & Miller LLC; Donald R. Fraser

(57) ABSTRACT

A variable tip nozzle and cap assembly is disclosed for a dispensing pouch which contains a confectionery, the assembly including threaded portions of different diameters which receive decorating tips for application of the confectionery as a decoration to cakes and cookies, for example.

10 Claims, 4 Drawing Sheets

VARIABLE TIP NOZZLE AND CAP ASSEMBLY FOR DISPENSING POUCH

CROSS-REFERENCE TO RELATED APPLICATION

This patent application is a Divisional of U.S. patent application Ser. No. 10/886,896, filed Jul. 8, 2004.

FIELD OF THE INVENTION

The present invention relates to a nozzle and cap assembly and more particularly to a variable tip nozzle and cap assembly for a pouch for dispensing a confectionery used in the decoration of cakes and cookies, for example.

BACKGROUND OF THE INVENTION

The application of a flowable confectionery to the top and sides of an iced cake or other pastry is well known in the art. Typically, the confectionery is sufficiently viscous to maintain a shape and is resistant to excessive flow or slumping after being extruded or dispensed from an associated bag or dispensing pouch. Some types of icing may tend to surface harden by reason of water evaporation after being dispensed from the pouch and, accordingly, it is desirable that the pouch and the dispensing system be substantially leak-proof to prevent evaporation of water and the resultant hardening of the contents prior to application. Typically, flexible and collapsible dispensing pouches of the type utilized for decorating cakes and cookies employ a dispensing nozzle, through which a flowable confection such as cake icing may be extruded. An example of a dispensing system is shown and described in assignee's commonly owned U.S. patent application Ser. No. 10/275,017, the contents of which are hereby incorporated herein by reference.

Prior art dispensing nozzles for a dispensing pouch are adapted to receive a decorating tip either alone or with a cooperating collar or compression ring. The collar threadingly engages a threaded portion of the dispensing nozzle to hold the decorating tip in place. The flowable confection is caused to be extruded through the decorating tip by collapsing the dispensing pouch by the application of pressure thereto. The shape of the free end of the decorating tip determines the final shape of the extruded confection.

In order to create extruded designs of a different type or size, use of a different decorating tip is required. Often, this requires that a different pouch and nozzle/tip assembly be used thereby exposing the confection stored in the dispensing pouch to air, resulting in drying and surface hardening.

It would be desirable produce a nozzle and cap assembly for a dispensing pouch which accepts decorating tips of different sizes and shapes to maximize decorating efficiency.

SUMMARY OF THE INVENTION

Consistent and consonant with the present invention, a nozzle and cap assembly for a dispensing pouch which accepts decorating tips of different sizes and shapes to maximize decorating efficiency and minimize wasted confection due to surface hardening, has surprisingly been discovered.

In one embodiment, the nozzle and cap assembly comprises a hollow nozzle section having a first end and a second end, the first end adapted to be joined with a container, the second end having a first threaded section and a second threaded section formed thereon, the first threaded section having a different diameter than the second threaded section; a first threaded collar adapted to be received on the first threaded section, the first threaded collar having a central aperture formed therein adapted to receive a first decorating tip therein, the first threaded collar cooperating with the first threaded section of the nozzle section to urge the first decorating tip into engagement with the nozzle section; a second threaded collar adapted to be received on the second threaded portion, the second threaded collar having a central aperture formed therein adapted to receive a second decorating tip therein, the second threaded collar cooperating with the second threaded section of the nozzle section to urge the second decorating tip into engagement with the nozzle section.

In another embodiment, the nozzle and cap assembly comprises a hollow nozzle section having a first end and a second end, the first end adapted to be joined with a container, the second end having a first threaded section and a second threaded section formed thereon, the first threaded section having a different diameter than the second threaded section; a first threaded collar having a central aperture formed therein and adapted to be received on the first threaded section of the nozzle section; a first decorating tip received in the aperture of the first threaded collar, the first threaded collar cooperating with the first threaded section of the nozzle section to urge the first decorating tip to sealingly engage the nozzle section; a second threaded collar having a central aperture formed therein and adapted to be received on the second threaded portion of the nozzle section; a second decorating tip received in the aperture of the second threaded collar, the second threaded collar cooperating with the second threaded section to urge the second decorating tip to sealingly engage the nozzle section.

In another embodiment, the nozzle and cap assembly comprises a flexible dispensing pouch having an opening formed therein; a hollow nozzle section having a first end and a second end, the first end joined with the dispensing pouch in the opening, the second end having a first threaded section and a second threaded section formed thereon, the first threaded section having a different diameter than the second threaded section; a first threaded collar adapted to be received on the first threaded section, the first threaded collar having a central aperture formed therein adapted to receive a first decorating tip therein, the first threaded collar cooperating with the first threaded section of the nozzle section to urge the first decorating tip into engagement with the nozzle section; a second threaded collar adapted to be received on the second threaded portion, the second threaded collar having a central aperture formed therein adapted to receive a second decorating tip therein, the second threaded collar cooperating with the second threaded section of the nozzle section to urge the second decorating tip into engagement with the nozzle section.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
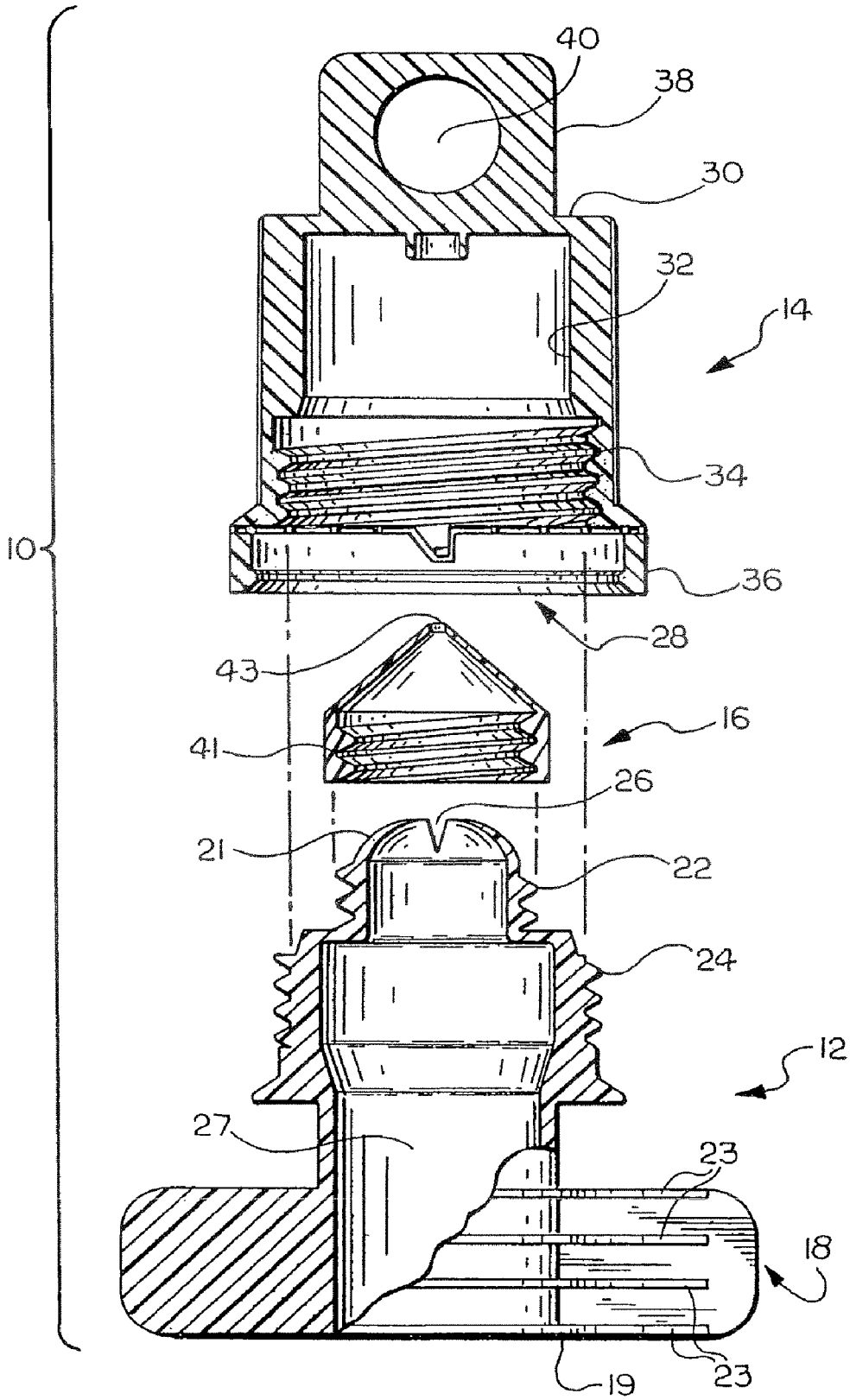
FIG. 1 is an exploded elevational view partially in section of a nozzle and cap assembly for a dispensing pouch according to an embodiment of the invention.
Figure 2:
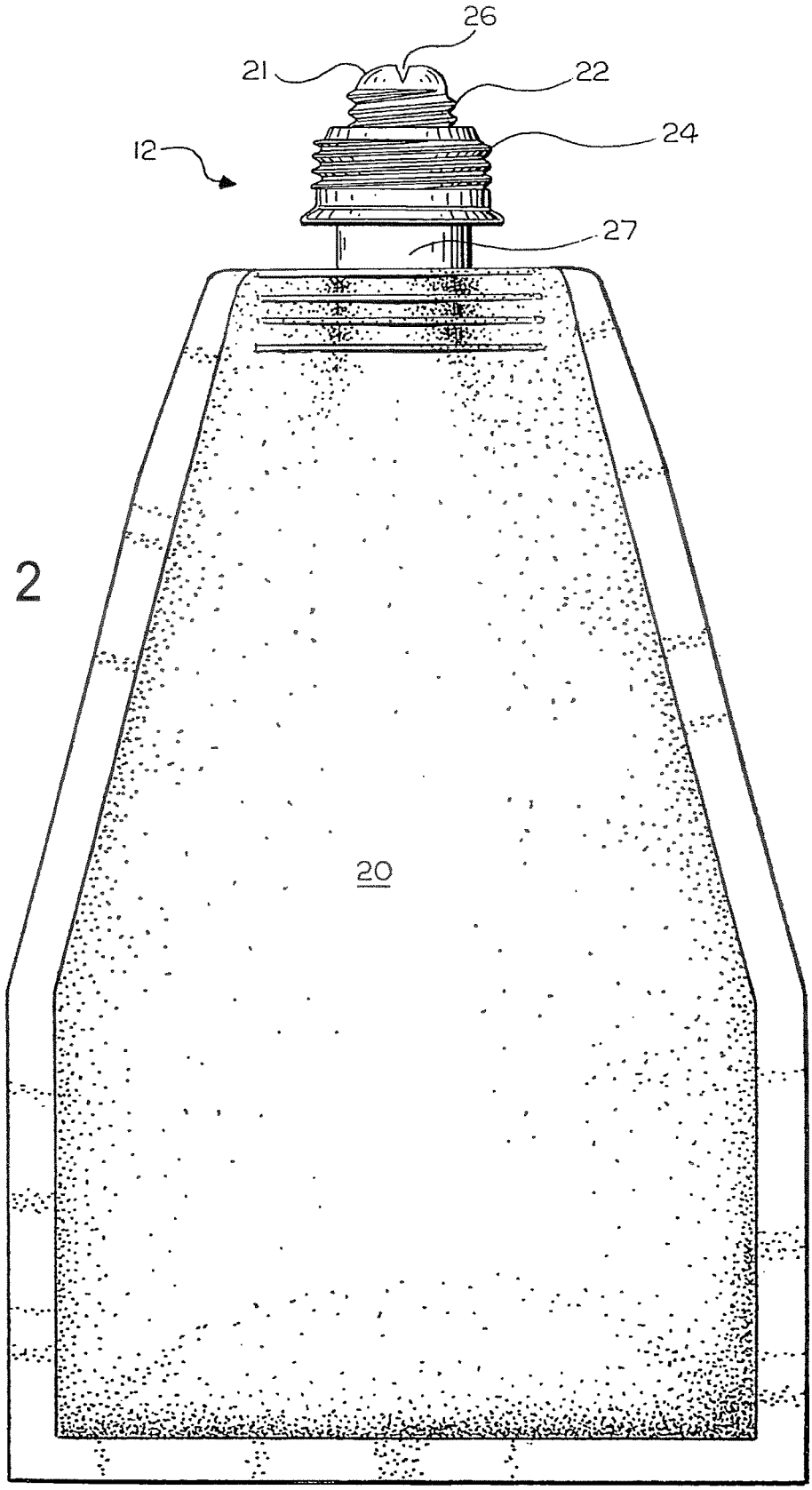
FIG. 2 is an elevational view of the nozzle of FIG. 1 showing the nozzle connected to an outlet of an associated dispensing pouch.

Referring now to FIG. 1, a nozzle and cap assembly 10 according to an embodiment of the invention is shown. The nozzle and cap assembly 10 includes a hollow nozzle section 12, a cap section 14, and a hollow tip 16. A radially outwardly extending collar 18 is formed at a first end 19 of the nozzle section 12. The collar 18 includes a plurality of spaced apart ribs 23 and is adapted to be joined with a container or flexible dispensing pouch 20, as shown in FIG. 2. A second end 21 of the nozzle section 12 includes a first threaded section 22 of a first diameter and a second threaded section 24 of a second diameter. The first diameter is smaller than the second diameter. An opening 26 is formed on the second end 21 of the nozzle section 12 and provides communication with the hollow interior 27.

The cap section 14 has an open end 28, a closed end 30, and a hollow interior formed by an interior wall 32. At least a portion of the interior wall 32 has a threaded portion 34 formed thereon. In the embodiment shown, the threaded portion 34 has the same diameter as the second threaded section 24. A safety ring 36 is releasably attached to a first end of the cap section 14. A hanger tab 38 is disposed at a second end of the cap section 14. An aperture 40 is formed in the hanger tab 38.

The tip 16 includes a threaded section 41 adjacent a first end thereof adapted to threadingly engage the first threaded portion 22. A second end of the tip 16 includes an aperture 43. The cross-sectional shape and configuration of the aperture 43 shown in the drawings is meant to be exemplary, and it is understood that other shapes and configurations can be used without departing from the scope and spirit of the invention.

Figure 3:
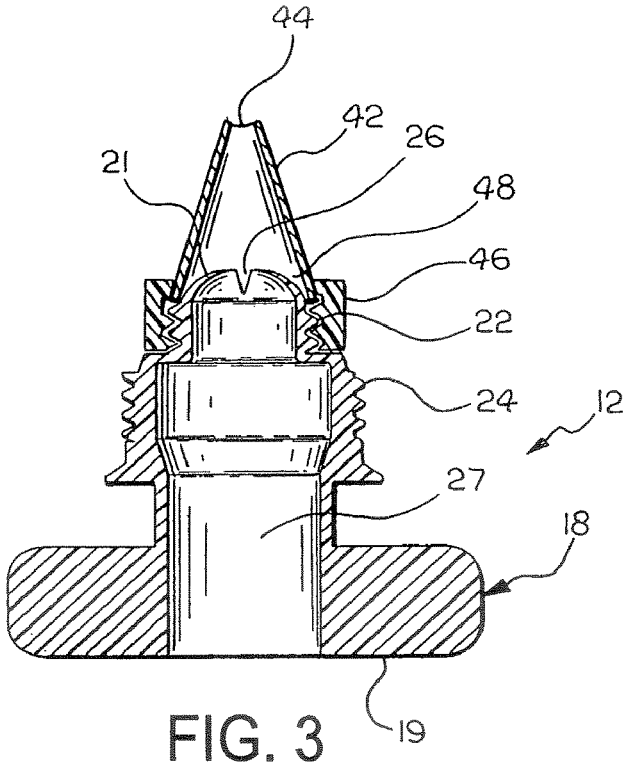
FIG. 3 is a cross sectional view of the nozzle of FIG. 1 shown with a decorating tip and a collar of a first diameter attached thereto.

FIG. 3 illustrates the nozzle section 12 having a first decorating tip 42 disposed adjacent the second end 21 thereof. An opening 44 is formed at a distal end of the first tip 42. The first tip 42 is adapted to abut the second end 21 to form a seal therebetween. A first threaded collar or compression ring 46 receives the first tip 42 in a centrally disposed aperture 48. The first collar 46 threadingly engages the first threaded section 22 of the nozzle section 12 to urge the first tip 42 into engagement with the second end 21 to create and maintain the seal between the first tip 42 and the second end 21.

Figure 4:
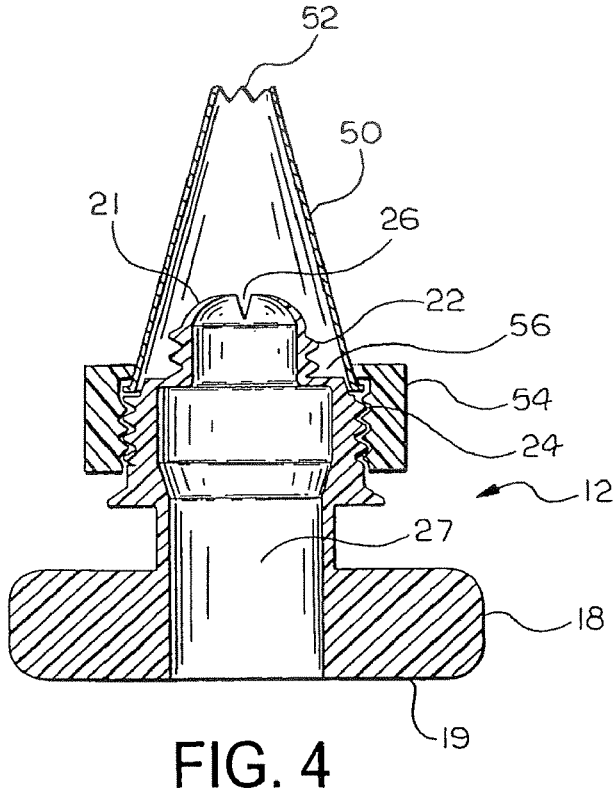
FIG. 4 is a cross sectional view of the nozzle of FIG. 1 shown with a decorating tip and a collar of a second diameter attached thereto.

In FIG. 4, the nozzle section 12 is shown with a second decorating tip 50 disposed adjacent the second end 21 thereof. An opening 52 is formed at a distal end of the second tip 50. The second tip 50 is adapted to abut a portion of the nozzle section 12 between the first threaded section 22 and the second threaded section 24 to form a seal. A second threaded collar or compression ring 54 receives the second tip 50 in a centrally disposed aperture 56. The second collar 54 threadingly engages the second threaded section 24 of the nozzle section 12 to urge the second tip 50 into engagement with the nozzle section 12 to create and maintain the seal between the second tip 50 and the nozzle section 12.

Figure 5:
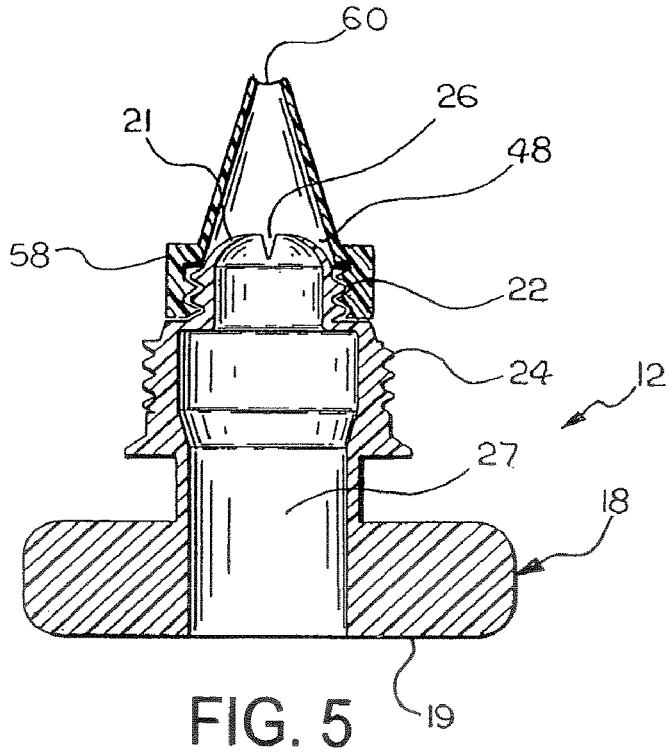
FIG. 5 is a cross sectional view of the nozzle of FIG. 1 shown with a unitary decorating tip of a first diameter attached thereto.

FIG. 5 shows the nozzle section 12 having a first threaded unitary decorating tip 58 disposed on the second end 21 thereof. An opening 60 is formed at a distal end of the first unitary tip 58. The first unitary tip 58 threadingly engages the first threaded section 22 of the nozzle section 12 to create and maintain a seal between the first unitary tip 58 and the second end 21.

Figure 6:
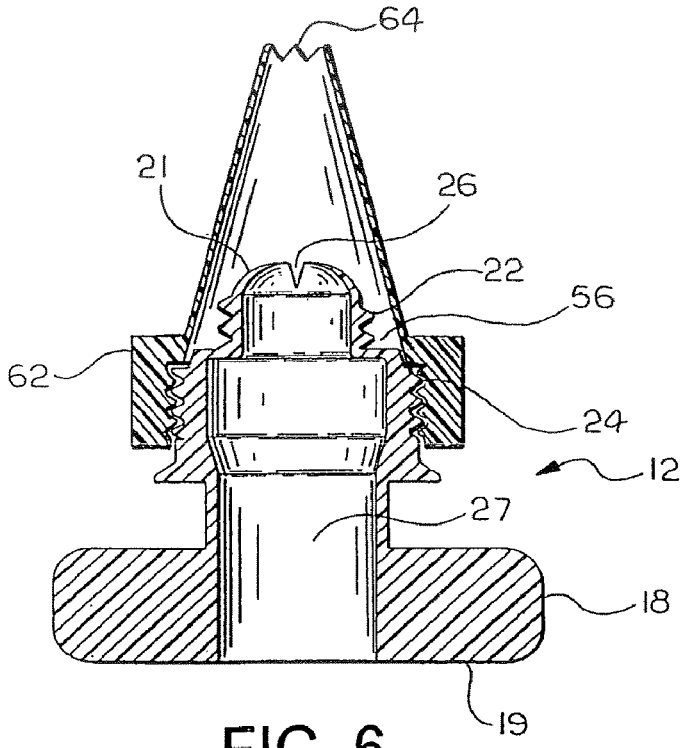
FIG. 6 is a cross sectional view of the nozzle of FIG. 1 shown with a unitary decorating tip of a second diameter attached thereto.

In FIG. 6, the nozzle section 12 is shown with a second threaded unitary decorating tip 62 disposed thereon. An opening 64 is formed at a distal end of the second unitary tip 62. The unitary tip 62 threadingly engages the second threaded section 24 of the nozzle section 12 to create and maintain a seal between the second unitary tip 62 and the nozzle section 12.

As assembled, the nozzle and cap assembly 10 is typically provided with the collar 18 of the nozzle section 12 suitably joined with the dispensing pouch 20 at an open end thereof, as shown in FIG. 2. The ribs 23 of the collar 18 cooperate with the walls of the dispensing pouch 20 to provide a leak proof seal therebetween. The collar 18 can be joined with the bag 20 by any conventional joining method such as heat sealing and gluing, for example.

The tip 16 is provided with the nozzle and cap assembly 10 threaded on the first threaded section 22. The cap section 14 is threaded to the second threaded section 24. The hanger tab 38 is used to suspend the nozzle and cap assembly 10 and dispensing pouch 20 for storage, for example.

In use, the cap section 14 is removed from the nozzle section 12. To dispense a confectionery from the dispensing pouch 20 through the nozzle section 12, pressure is applied to the outside of the dispensing pouch 20 by a user. The confectionery is then caused to be extruded through the opening 26. The nozzle section 12 can be provided without the opening 26, thus requiring that a hole be formed by puncturing or other means to create an outlet for the confectionery. A variety of tips 16, 42, 50, 58, 62 can be used to create shapes and sizes of extruded confectionery as desired. For example, to create writing on a cake, the tip 16 can be used to create an extruded ribbon having a substantially circular cross section. The first decorating tip 42 can be used to create a small flower or extruded ribbon. The second decorating tip 50 can be used to create a large flower or extruded ribbon. If no tips are used, the opening 26 can be used to create an extruded flat ribbon of confectionery which can be used to create flowers or other shapes as desired. It is understood that types of openings other than those shown and described can be provided in the tips 14, 16, 42, 50, 58, 62 and the first end 21 of the nozzle section 12 as desired.

By providing the first threaded section 22 and the second threaded section 24 on the nozzle section 12, a variety of types of decorating tips 42, 50, 58, 62 can be used to create a variety of extruded confectionery shapes as desired. Additionally, the first threaded section 22 and the second threaded section 24 facilitate the use of different sized decorating tips 42, 50, 58, 62, providing even more flexibility in creating different extruded designs. The threaded sections 22, 24 can be sized to accept standard decorating tips such as Wilton type tips, Dec-A-Cake type tips, Tones Brothers type tips, Cake Mate type tips, and Betty Crocker type tips, for example. Although confectionery materials have been used for exemplary purposes, it is understood that other materials such as cheese, for example, can be used without departing from the scope and spirit of the invention.

The cross-sectional shape and configuration of the aperture 43 shown in the drawings is meant to be exemplary, and it is understood that other shapes and configurations can be used without departing from the scope and spirit of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A nozzle for a confectionary container comprising:

a hollow unitary nozzle section having a first end and a second end, the first end adapted to be joined with the container, the second end having a first exterior threaded section and a second exterior threaded section, the first exterior threaded section having a different diameter from the second exterior threaded section, wherein the first end of the hollow unitary nozzle section has a radially outwardly extending collar including a plurality of spaced apart ribs adapted to cooperate with the container to form a substantially leak proof seal therebetween;

a threaded member removably received on at least one of the first exterior threaded section and the second exterior threaded section of the hollow unitary nozzle section, wherein the threaded member is a cap having an interior threaded portion; and a safety ring releasably attached to the threaded member.

2. The nozzle according to claim 1, wherein the cap includes a hanger tab having an aperture formed therein.

3. The nozzle according to claim 2, wherein the hanger tab is configured to suspend the nozzle during a storage thereof.

4. The nozzle according to claim 1, wherein the second end of the hollow unitary nozzle section includes an opening formed therein.

5. The nozzle according to claim 1, wherein the first exterior threaded section and the second exterior threaded section have threads oriented in the same direction.

6. A nozzle for a confectionary container comprising:

a hollow unitary nozzle section having a first end and a second end, the first end adapted to be joined with the container, the second end having a first exterior threaded section and a second exterior threaded section, the first exterior threaded section having a different diameter from the second exterior threaded section, wherein the first end of the hollow unitary nozzle section has a radially outwardly extending collar including a plurality of spaced apart ribs adapted to cooperate with the container to form a substantially leak proof seal therebetween;

a threaded member removably received on at least one of the first exterior threaded section and the second exterior threaded section of the hollow unitary nozzle section, wherein the threaded member is a cap having an interior threaded portion; and a hanger tab disposed on the cap and having an aperture formed therein.

7. A nozzle for a confectionary container comprising:

a hollow unitary nozzle section having a first end and a second end, the first end adapted to be joined with the container, the second end having a first exterior threaded section and a second exterior threaded section, the first exterior threaded section having a different diameter from the second exterior threaded section, wherein the first end of the hollow unitary nozzle section has a radially outwardly extending collar including a plurality of spaced apart ribs adapted to cooperate with the container to form a substantially leak proof seal therebetween;

a decorating tip having an interior threaded portion removably received on the first exterior threaded section of the hollow unitary nozzle section; and a cap having an interior threaded portion removably received on the second exterior threaded section of the hollow unitary nozzle section.

8. The nozzle according to claim 7, wherein the decorating tip includes an interior threaded collar having a central aperture, wherein the threaded collar cooperates with the one of the fist exterior threaded section and the second exterior threaded section to urge the decorating tip into sealing engagement with the second exterior threaded section of the hollow unitary nozzle section.

9. New The nozzle according to claim 7, wherein the decorating tip is a hollow tip having a first end and a second end, the first end adapted to be received on the hollow unitary nozzle section, the second end of said tip having an opening formed therein.

10. New The nozzle according to claim 7, wherein the decorating tip is configured to extrude a ribbon of confectionary.

* * * * *